US005149002A

United States Patent [19]

Sugioka

[11] Patent Number: 5,149,002

[45] Date of Patent: Sep. 22, 1992

[54] YARN TRAVERSING APPARATUS

[75] Inventor: Takami Sugioka, Matsuyama, Japan

[73] Assignee: Teijin Seiki Co., Ltd., Osaka, Japan

[21] Appl. No.: 774,163

[22] Filed: Oct. 15, 1991

Related U.S. Application Data

[63] Continuation of Ser. No. 470,951, Jan. 26, 1990, abandoned.

[30] Foreign Application Priority Data

Feb. 4, 1989 [JP] Japan ..... 1-26384

[51] Int. Cl.[5] ..... B65H 54/28

[52] U.S. Cl. ..... 242/43 A; 242/158 B

[58] Field of Search ..... 242/43 A, 43 R, 158 B

[56] References Cited

U.S. PATENT DOCUMENTS

| | | | |
|---|---|---|---|
| 2,238,128 | 4/1941 | Nydegger | 242/158 B X |
| 3,333,782 | 8/1967 | Beckwith, Jr. | 242/158 B X |
| 3,362,652 | 1/1968 | Butterworth | 242/43 A |
| 3,491,962 | 1/1970 | Roberts | 242/158 B X |
| 3,650,486 | 3/1972 | Hasegawa et al. | 242/43 A |
| 4,505,437 | 3/1985 | Schippers et al. | 242/43 A |
| 4,646,983 | 3/1987 | Schippers et al. | 242/43 A |

*Primary Examiner*—Stanley N. Gilreath

*Attorney, Agent, or Firm*—Rothwell, Figg, Ernst & Kurz

[57] ABSTRACT

An apparatus for traversing a yarn along a bobbin, with which a contact roller contacts. The traversing apparatus is disposed below a fulcrum for traverse motion and comprises:

a frame downwardly inclined relative to the moving direction of the yarn;

spindles rotatably supported on the frame at apexes of a rectangle;

first traverse blades, spaced downwardly from the fulcrum for traverse motion by a predetermined distance and secured to the spindles located remotely from the yarn, for traversing the yarn from ends of traverse stroke toward a center of the traverse stroke; and second traverse blades, spaced downwardly from the first traverse blades by a predetermined distance and secured to the spindles located closer to the yarn relative to the remote spindles, for traversing the yarn, which has been transferred from the first traverse means, from the center of traverse stroke towards the ends of traverse stroke.

7 Claims, 4 Drawing Sheets

YARN TRAVERSING APPARATUS

This is a continuation of application Ser. No. 07/470,951, filed Jan. 26, 1990, now abandoned.

BACKGROUND OF THE INVENTION

This invention relates to a yarn traversing apparatus for obtaining a wound yarn package with a good wound shape and without cob-webbing at a high speed winding.

More specifically, the present invention relates to a yarn traversing apparatus, which comprises at least one pair of rotary blades which rotate in opposite directions and which apparatus transfers the yarn between the blades.

Conventionally known yarn traversing apparatuses of the above-described type are, for example, disclosed in Japanese Patent Publication No. Sho 53-22178, Japanese Patent Publication No. Sho 46-36258, and Japanese Patent Laid-open No. Sho 59-194977.

However, in these conventionally known apparatuses, a yarn temporarily becomes in a free condition, i.e., the yarn becomes in an unstable condition, when the yarn is transferred from one of oppositely rotating yarn guides to the other yarn guide. Accordingly, there occurs a disadvantage that the obtained yarn quality is deteriorated because high shoulders are formed at ends of the package corresponding to traverse ends. Further, there occurs another disadvantage, which is sometimes referred to as "cob-webbing" and wherein a yarn wound on the shoulders is slipped down from the shoulders. Especially, when a yarn is wound at a high speed higher than 5,000 m/min, the yarn is fluctuated due to the moment of inertia when the traverse motion is reversed, and the above-described disadvantages are remarkable.

In order to obviate the above-described disadvantages, in Japanese Patent Publication No. Sho 54-3985, it is proposed to dispose deflecting guides at certain positions inside the area encircled by lines connecting the traverse ends and a fulcrum of the traverse motion.

However, the deflecting guides serve the yarn only for very limited regions near the traverse ends. Accordingly, the fluctuation of the yarn is not fully prevented from occurring at the traverse ends due to the moment of inertia. As a result, there often occurs a so called cob-webbing wherein a yarn wound on the shoulders is slipped down from the shoulders, and further winding of a yarn becomes impossible.

If it is desired to fully prevent such phenomena, the deflecting guides which are disposed above the traverse guide must be displaced toward the center of the traverse stroke. However, if this attempt is applied, the deflecting angle of the yarn at the deflecting guides increases, and the yarn is strongly rubbed against the deflecting guide. Accordingly, there is a disadvantage that the yarn quality is deteriorated since the tension in the yarn is enhanced.

SUMMARY OF THE INVENTION

It is an object of the present invention to provide a new traversing apparatus, by which the above-described disadvantages are obviated.

It is another object of the present invention to provide a traversing apparatus, by which a yarn is surely traversed and wound in a package without forming high shoulders or cob-webbing.

According to the present invention, the above-described disadvantages are obviated and the above-described objects are achieved by an apparatus for traversing a yarn along a bobbin, with which a contact roller contacts, the traversing apparatus disposed below a fulcrum for traverse motion and comprising:

a frame downwardly inclined relative to the moving direction of the yarn;

a first traverse means for traversing the yarn from ends of traverse stroke toward a center of the traverse stroke, which means is rotatably supported on the frame and spaced downwardly from the fulcrum for traverse motion by a predetermined distance, and which means comprises at least a pair of rotary blades;

centers of rotation of the rotary blades of the first traverse means being located near the ends of traverse stroke; and a second traverse means for traversing the yarn, which has been transferred from the first traverse means, from the center of traverse stroke toward the ends of traverse stroke, which means is rotatably supported on the frame and spaced from the first traverse means by a predetermined distance, and which means comprises at least a pair of rotary blades;

centers of rotation of the rotary blades of the second traverse means being located near the ends of traverse stroke and in front of the centers of rotation of the rotary blades of the first traverse means.

Especially, it is preferred that the yarn traversing apparatus is so arranged that when the yarn moved to the end of traverse stroke by the second traversing means is engaged with the first traversing means, the yarn is released from a yarn guide of the second traversing means after it is moved by the yarn guide of the second traversing means to a position where the fulcrum for traverse motion, the first traversing means and a point where the yarn moved by the first traversing means is in contact with the contact roller are aligned on a straight line or are slightly deviated from the straight line. More specifically, it is more preferred that the yarn traversing apparatus according to the present invention is so arranged that the yarn is released from one of the rotary guides of the second traversing means after it is moved by one of the rotary guides of the second traversing means to a position where the fulcrum for traverse motion, the first traversing means and a contact point where the yarn moved by the first traversing means is in contact with the contact roller are slightly deviated opposite to the center of the traverse stroke from a straight line connecting the fulcrum for traverse motion and the contact point.

According to the present invention, since the yarn is moved by the second traverse means from the center of traverse stroke toward the end of traverse stroke, and then the yarn moved to the end of traverse stroke is moved by the first traversing means from the end of traverse stroke toward a center of traverse stroke, thereafter, the yarn moved toward the center of traverse stroke is moved by the second traversing means from the center of traverse stroke toward the other end of traverse stroke, the yarn moved to the end of traverse stroke is transferred to the first traversing means so as to move the yarn from the end of traverse stroke toward a center of traverse stroke and the yarn moved toward the center of traverse stroke is transferred to the second traversing means, the yarn does not become in a free condition, i.e., the yarn becomes in a stable condition, when the yarn is transferred from one of yarn guides to the other yarn guide. Accordingly, there do not occur disadvantages that the obtained yarn quality is deteriorated because high shoulders are not formed on the package or because cob-webbings do not occur at ends of the package.

BRIEF DESCRIPTION OF THE DRAWINGS

The present invention will now be explained in detail with reference to the accompanying drawings, wherein:

FIGS. 1 to 4 illustrate an embodiment of a traversing apparatus of the present invention, wherein:

FIG. 1 is a schematic front view of a winding apparatus wherein the traversing apparatus of the present invention is installed;

FIG. 2 is a plan view seen in a direction of arrow A in FIG. 1 and showing the traversing apparatus of the present invention;

FIG. 3 is a detailed front view of a unit;

FIG. 4 is a cross sectional view seen in a direction of line 4—4 in FIG. 3.

PREFERRED EMBODIMENTS

Figure 1:
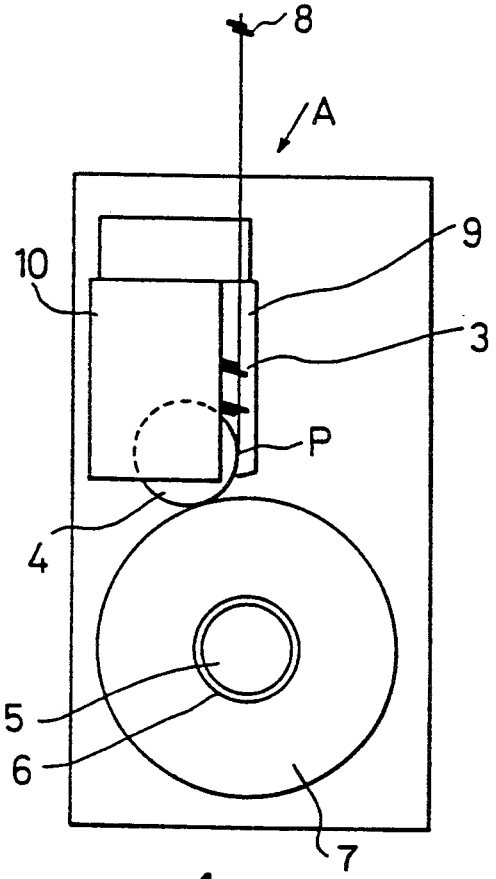

An embodiment of the present invention will now be described with reference to the accompanying drawings, wherein FIG. 1 is a schematic view seen from the front of a winding apparatus of the present invention.

After a yarn Y is drawn by a drawing apparatus (not illustrated), the yarn Y is fed through a snail guide 8, which serves as a fulcrum of traverse motion, and is wound by a winding apparatus (not numbered).

The winding apparatus comprises a traversing apparatus 3 for traversing the yarn Y to and fro, a contact roller 4 and a bobbin holder 5.

The traversing apparatus 3 and the contact roller 4 are mounted on a slide block 9 which is vertically movable on the frame of the winding machine.

Figure 4:
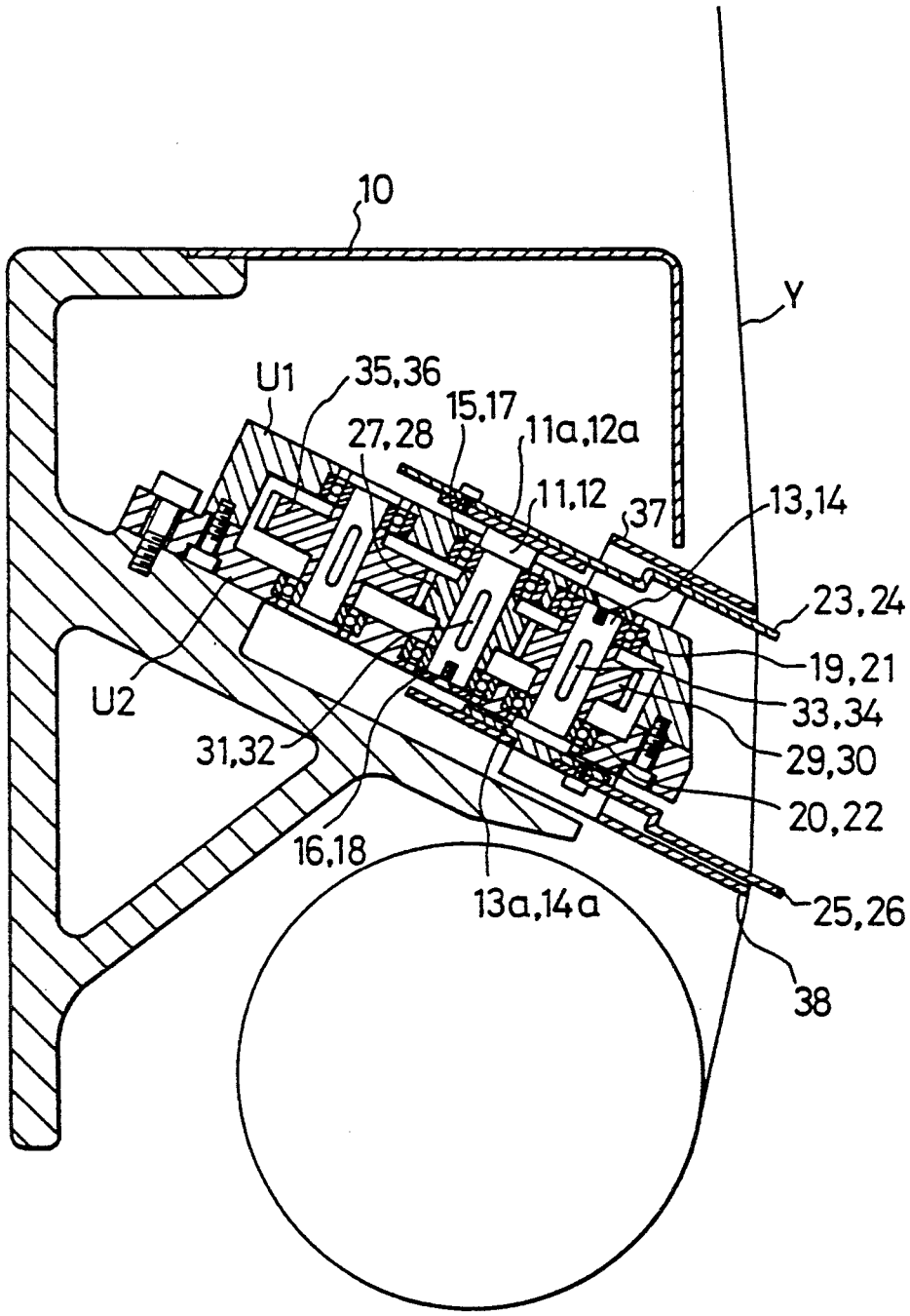

A slide block 9 has a frame 10 projecting therefrom, and the frame 10 has the contact roller 4 rotatably mounted thereon. The frame 10 further has a base. The base is above the contact roller 4 and is inclined downwardly (in this embodiment 30° from a horizontal plane) as illustrated in FIG. 4. The traversing apparatus 3 is installed on the base.

The bobbin holder 5 is rotatably supported on a machine frame and has two bobbins 6 inserted thereonto in the present embodiment. The contact roller 4 is pressed to the bobbins 6 inserted onto the bobbin holder 5.

After the yarn Y is traversed to and fro (in a direction perpendicular to the sheet) by the traversing apparatus 3, it reaches the contact roller 4 at a point P and wraps around the contact roller, and the yarn Y is wound onto the bobbin 6, which is inserted onto the bobbin holder 5 and which is driven by the contact roller 4, to form a yarn package 7. A main moving direction of the yarn is defined to be the direction fro the fulcrum 8 to the bobbin 6.

The construction of the traversing apparatus 3 of the present embodiment will now be explained in detail.

Figure 2:
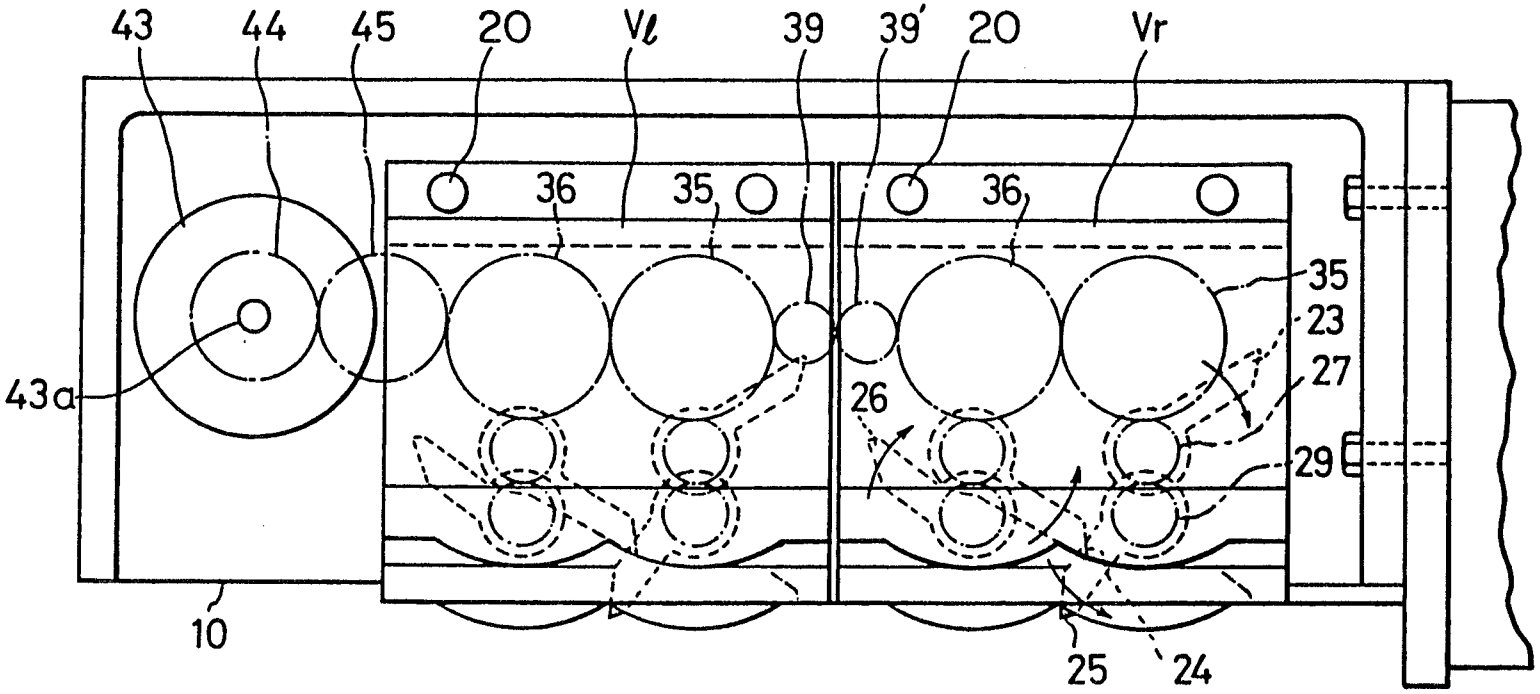

As illustrated in FIG. 2, a pair of units Vl and Vr are detachably secured to the base of the frame 10 by bolts 20.

As illustrated in FIG. 4, each unit comprises two members U1 and U2, which can be separated. Between the upper and lower members U1 and U2, a spindle 11 is rotatably installed via bearings 15 and 16, a spindle 12 is rotatably installed via bearings 17 and 18, a spindle 13 is rotatably installed via bearings 19 and 20, and further, a spindle 14 is rotatably installed via bearings 21 and 22.

Figure 3:
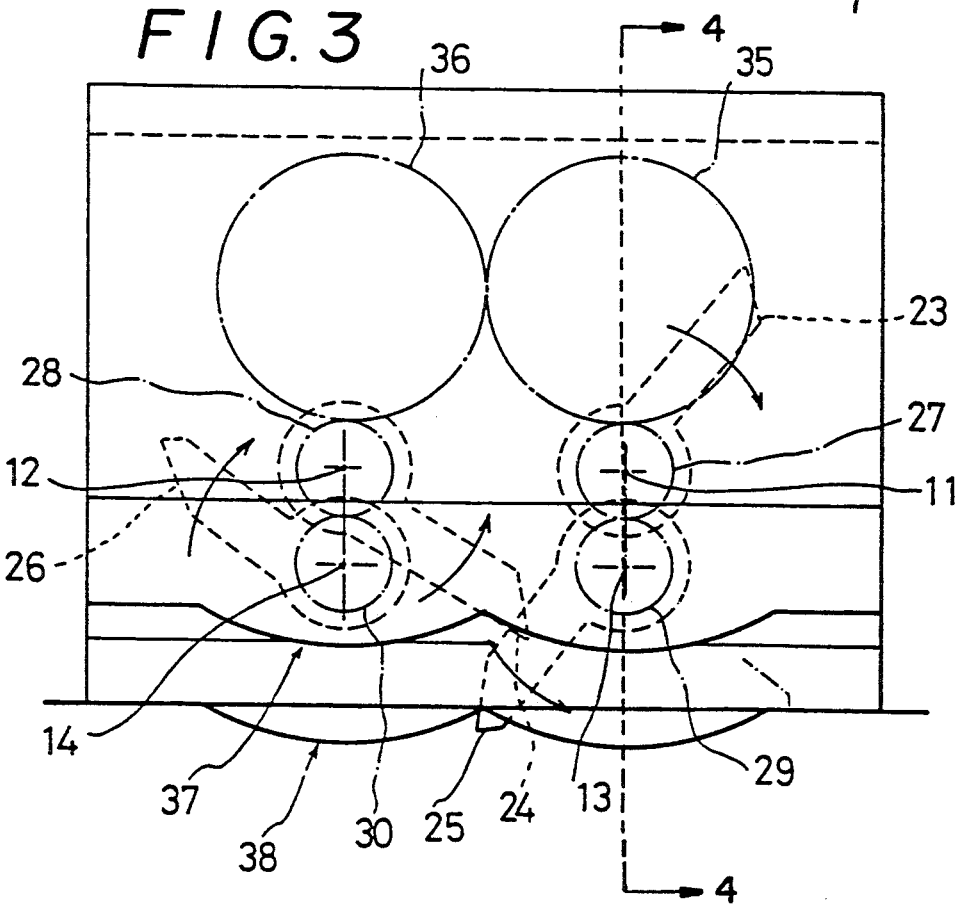

As illustrated in FIGS. 2 and 3, the spindles 11, 12, 13 and 14 are located at apexes of an imaginary rectangle. Further, each of the spindles 11, 12, 13 and 14 has a boss 11*a*, 12*a*, 13*a* or 14*a* formed at an upper or lower end thereof, which boss has a blade 23, 24, 25 or 26 for traversing a yarn secured thereto.

The blades 23, 24, 25 and 26 are so arranged that planes which are formed by the rotations of the blades 23, 24, 25 and 26 are perpendicular to a plane formed by the traversing motion of the yarn Y or that the former planes are inclined downward (in this embodiment 30°) in a feeding direction of the yarn Y relative to the latter plane formed by the traversing motion of the yarn Y.

Further, each of the spindles 11, 12, 13 and 14 has a gear 27, 28, 29 or 30 secured thereto by a key 31, 32, 33 or 34 at an intermediate portion thereof between a pair of the upper and lower bearings 15 and 16, 17 and 18, 19 and 20 or 21 and 22.

In FIGS. 2 and 3, the gears 27 and 29 mesh with each other, and similarly the gears 28 and 30 mesh with each other. Further, the gears 35 and 36 mesh with each other, and the gears 27 and 28 also mesh with the gears 35 and 36, respectively.

Thus, the blades 23 and 24, which are disposed at upper (see FIG. 4) and backward (see FIGS. 2 and 3) positions, are so constructed that they transfer the yarn Y toward the center of the traverse stroke. The blades 23 and 24 will be referred to as the first traversing means hereinbelow.

Contrary to this, the blades 25 and 26, which are disposed at lower (see FIG. 4) and front (see FIGS. 2 and 3) positions, are so constructed that they transfer the yarn Y from a point around the center of the traverse stroke to the outside. The blades 25 and 26 will be referred to as the second traversing means hereinbelow.

The upper member U1 of the unit has a guide rail 37 secured thereto, and the lower member U2 of the unit has a guide rail 38 secured thereto.

The guide rails 37 and 38 are located above the blades 23 and 24 and downstream the blades 25 and 26, respectively. The contours of the guide rail 37 and 38 are so designed that the moving speed of the yarn transferred by the blades 25 and 26 along the guide rails 37 and 38 may be always almost constant. In this embodiment, the guides 37 and 38 are formed in a circular arc.

In FIGS. 2 and 3, when the yarn which has been moved from the right end of a traverse stroke by the upper right blade 23 reaches around the center of the traverse stroke, it is transferred to the lower left blade 26, which is rotating from the center of traverse stroke toward the left end of traverse stroke, and is moved to the left end of the traverse stroke by the lower left blade 26. Then, at the left end of the traverse stroke, the yarn is transferred to the upper left blade 24, which is rotating from the left end of traverse stroke toward the center of traverse stroke, and is moved to the center of the traverse stroke. Then, the yarn is transferred from the upper left blade 24 to the lower right blade 25 and is moved to the right end of the traverse stroke. Further, at the right end of the traverse stroke, the yarn is transferred from the lower right blade 25 to the upper right blade 23. Foregoing steps are repeated so as to traverse the yarn.

As illustrated in FIG. 2, a pair of gears 39 and 39' meshing with each other are disposed between adjacent two units Vr and Vl, and the left gear 39 also meshes with the gear 35 of the left unit Vl, while the right gear 39' also meshes with the gear 36 of the right side unit Vr. The gears 39 and 39' are rotatably supported by shafts (not shown) which are secured to the frame 10 via bearings (not shown), respectively.

Besides, a shaft (not shown) secured to the frame 10 has a gear 45 rotatably supported thereon via bearings (not shown), the gear 45 meshes with the gear 36 of the unit Vl.

A motor 43 is installed at the front end (at the left side in FIG. 2) of the frame 10, and a gear 44 is secured to an output shaft 43*a* of the motor 43. The gears 44 and 45 mesh with each other, and thus both the units Vl and Vr are driven by the motor 43.

It is preferred that the motor 43 is varied in rotational speed at a predetermined frequency and amplitude around a predetermined rotational speed while the yarn is wound so that ribbon windings are prevented from occurring.

Figure 5:
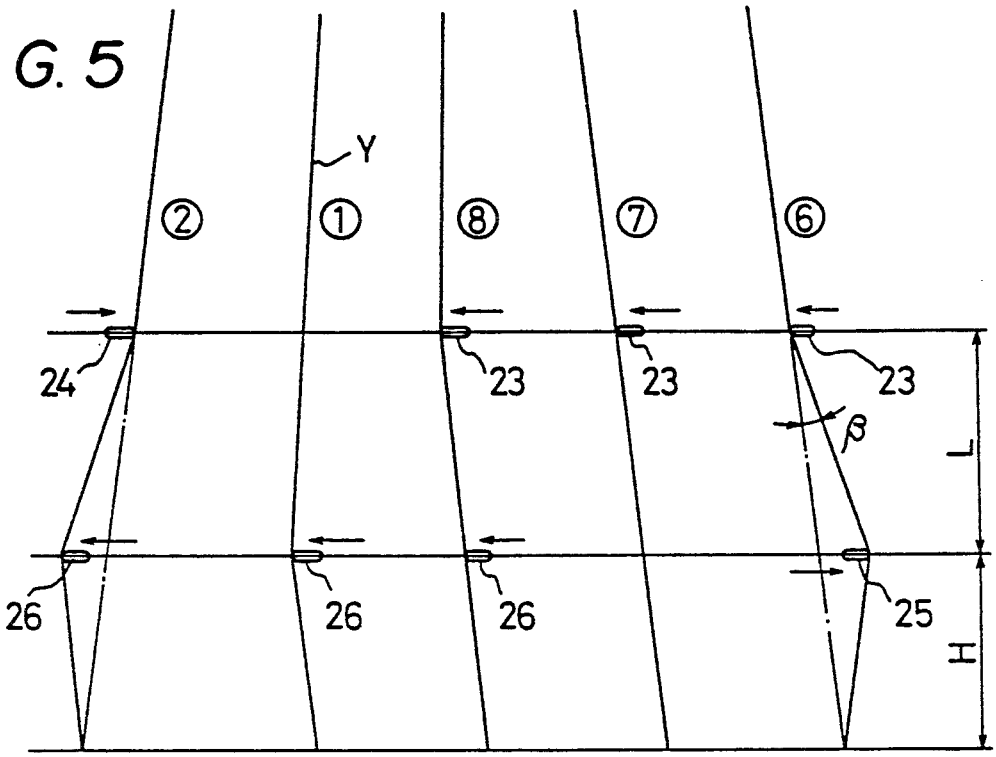
FIGS. 5 and 6 are front views, sequentially showing the conditions wherein a yarn is transferred while it is traversed.
Figure 6:
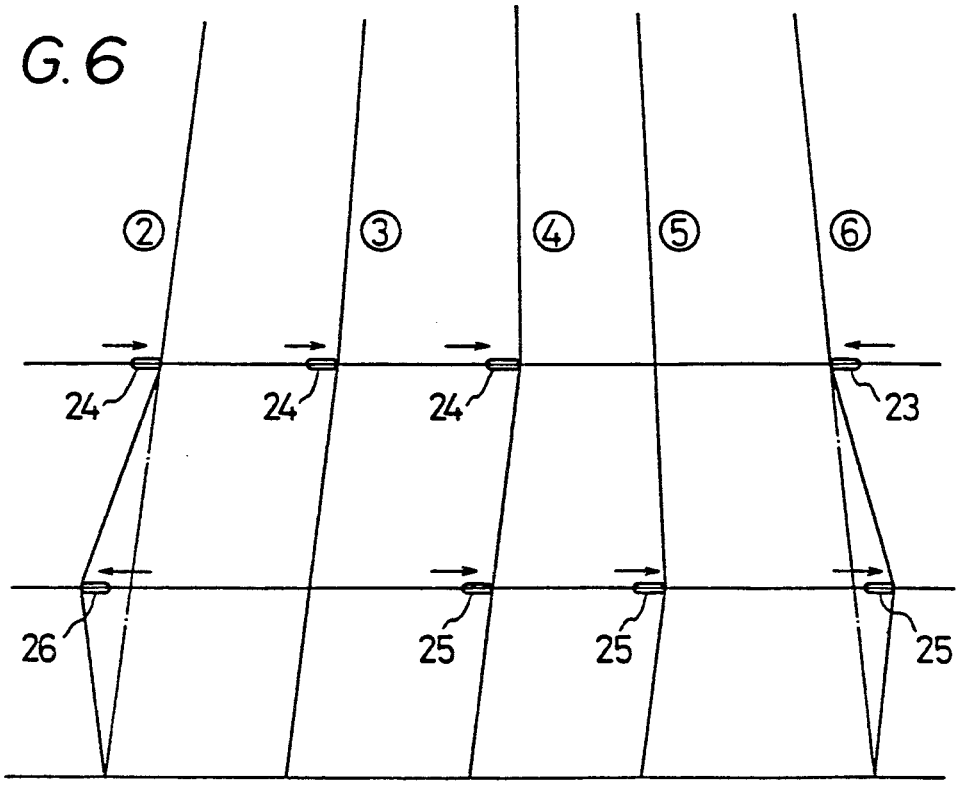

Referring to FIGS. 5 and 6, the yarn transferring steps of the present invention will now be explained. In FIGS. 5 and 6, the reference numerals enclosed by circles denote the sequence for transferring yarn.

At time (1), a yarn Y is moved to the left by the lower blade 26.

When the yarn Y reaches the turning point near the left end of the traverse stroke (condition denoted by (2)), the yarn comes to contact with the upper blade 24 which is rotating in the right, however, the lower blade 26 continues to engage with the yarn and to move the yarn to the left. At a position which lies on a straight line connecting the yarn and a contacting point on the contact roller 4 or at a position which is slightly deviated outwardly from said straight line as illustrated in FIG. 5, the yarn comes in contact with the guide rail 38, which is disposed near the lower blades 25 and 26, and is released from the lower blade 26 by means of the cooperation of the lower blade 26 and the guide rail 38.

The yarn released from the lower blade 26 is moved to the right, as illustrated by (3) in FIG. 6, by the upper blade 24.

When the yarn Y is moved to a position near the center of the traverse stroke as denoted by (4), the lower blade 25, which is spaced by a predetermined distance L from the upper blade 24 in a downward direction, comes in contact with the yarn Y, and the yarn Y is moved to the right as denoted by (5).

Then, when the yarn Y reaches the right traverse stroke end, i.e., when the yarn Y which has been moved by the lower blade 25 arrives at the right turning point (condition denoted by (6)), the upper blade 23, which is rotating to the left, comes in contact with the yarn. However, the lower blade 25 continues to move the yarn to the right. At a position which lies on a straight line connecting the yarn and a contacting point on the contact roller 4 or at a position which is slightly deviated outwardly from said straight line as illustrated in FIGS. 5 and 6, the yarn Y comes in contact with the guide rail 38, which is disposed near the lower blade 25, and the yarn Y is released from the blade 25 by the guide rail 38.

In this case, it is preferred that the yarn Y is deflected outwardly from an imaginary line connecting the fulcrum of traverse motion and the contacting point on the contact roller 4.

The yarn Y released from the lower blade 25 is moved to the left as illustrated by (7) in FIG. 5 by the upper blade 23.

As illustrated by (8), when the yarn Y is moved by the upper blade 23 to a position near the center of the traverse stroke, the lower blade 26, which is spaced by a predetermined distance L from the upper blade 23 in a downward direction, comes in contact with the yarn Y, and the yarn Y is moved to the left by the lower blade 26.

The yarn Y comes in contact with the guide rail 37, which is disposed near the upper blade 23, and is released from the upper blade 23, and then the yarn Y is moved to the left by the lower blade 26 as illustrated by (1).

Thereafter, the above-described transfer is repeated, and packages 7 are formed on the bobbins 6 inserted onto the bobbin holder 5.

In this embodiment, the distance H designates a distance from the contact roller to the second traverse means, the distance L designates a distance from the second traverse means to the first traverse means, and the ratio of the distance H to the distance L is set at a value of 1:1.1. It is preferred that the ratio is set at a value between 5:1 and 1:4.

If the ratio is too large, in other words, if the angle beta (see FIG. 5) between the yarn Y and the imaginary line connecting the fulcrum 8 for traverse motion and the contact point on the contact roller 4 is too large, the yarn Y may be strongly rubbed between the blades 23 and 25 or 24 and 26, and fluffs may occur or uneveness of the strength may occur. Thus, the yarn quality is deteriorated.

Contrary to this, if the ratio is too small, especially when a yarn is wound at a high speed, the yarn becomes unstable at the turning points of the traverse motion due to the moment of inertia, and cob-webbing may occur.

Although in this embodiment, the traversing apparatus 3 is disposed above the contact roller 4, the traversing apparatus may be disposed in such a manner that it faces the contact roller 4 and sandwiches the yarn Y between itself and the latter.

Further, in this embodiment, the plane formed by the blades is inclined by 30° toward the yarn feeding direction relative to the plane formed by the traversed yarn, however, another arrangement may be applicable.

Besides, in this embodiment, one blade is secured to one spindle, however, a plurality of blades may be secured to a spindle.

In addition, although the blades are secured to four spindles in this embodiment, the number of the spindles may be increased as long as the traversing apparatus comprises a first traverse means for traversing the yarn from ends of traverse stroke toward a center and a second traverse means for traversing the yarn from the center of traverse stroke toward ends of traverse stroke.

In addition, a manual winder provided with a single bobbin holder is exemplified in the above-described embodiment, however, the present invention is also applicable to an automatic winder which is provided with a plurality of bobbin holders.

Further, although traversing apparatuses are exemplified in the above-described embodiment, wherein two bobbins are inserted onto a bobbin holder, one package or more than two packages may be wound at the same time.

According to the present embodiment, the first traversing means and the second traversing means are constructed with rotary blades provided with yarn guides, which rotate in opposite directions, however, the present invention may be constructed with a first traversing means and a second traversing means which comprise endless members provided with yarn guides, which move in opposite directions.

As described above, according to the traversing method and apparatus of the present invention, a package with good wound shape and without any high shoulder can be obtained at high speed winding, and uneveness of the wound yarn can be prevented.

According to the present invention, the yarn is moved to a position which lies on a straight line connecting the yarn Y and the contacting point on the contact roller 4 or a position slightly deviated from said straight line in order to prevent the delay of the yarn which occurs at the reversing of the traverse motion, i.e., H×tan alpha, wherein H stands for a free length, and alpha stands for a winding angle. Accordingly, play or loosening of the yarn at the traverse reversing point does not occur, and the occurrence of high shoulder or cob-webbing can be prevented. Thus, according to a yarn traversing apparatus of the present invention, package with even hardness can be obtained.

What we claim is:

1. A yarn traversing apparatus for traversing a yarn back and forth across a predetermined traverse stroke, comprising:

first traversing means for traversing said yarn from ends of said traverse stroke toward the center of said traverse stroke;

second traversing means for traversing said yarn from the center of said traverse stroke toward said ends of said traverse stroke;

first rotational spindle means for rotationally supporting said first traversing means at one end thereof about first axes of rotation;

second rotational spindle means, mounted adjacent said first rotational spindle means and being rotationally engaged therewith, for rotationally supporting said second traversing means at one end thereof opposite said one end of said first rotational spindle means, about second axes of rotation parallel to said first axes of rotation;

said yarn being alternately transferred between said first and second traversing means so as to traverse said predetermined traverse stroke from one end thereof to the other end thereof.

2. A yarn traversing apparatus according to claim 1, further comprising a fulcrum for traverse motion engaging said yarn upstream of said first and second traversing means, and a contact roller pressing said yarn against a bobbin around which said traversing yarn is wound.

3. A yarn traversing apparatus according to claim 2, wherein said second traversing means is provided with a yarn guide, and which is so arranged that when said yarn moved to said end of traverse stroke by said second traversing means is engaged with said first traversing means, said yarn is released from said yarn guide after it is moved by said yarn guide to a position where said fulcrum for traverse motion, said first traversing means and a point where said yarn moved by said first traversing means is in contact with said contact roller are aligned on a straight line or are slightly deviated from said straight line.

4. A yarn traversing apparatus according to claim 3, which is so arranged that said yarn is released from said yarn guide of said second traversing means after it is moved by said yarn guide of said second traversing means to a position where said fulcrum for traverse motion, said first traversing means and said point where said yarn moved by said first traversing means is in contact with said contact roller are slightly deviated opposite to said center of said traverse stroke from said straight line.

5. A yarn traversing apparatus according to any one of claims 1, 3 or 4, wherein said first traversing means and said second traversing means comprise rotary blades and yarn guides, which rotary blades rotate in opposite directions.

6. An apparatus for traversing a yarn across a predetermined traverse stroke for winding said yarn around a bobbin, with which a contact roller contacts, said traversing apparatus disposed downstream of a fulcrum for traverse motion for receiving yarn moving in a main direction from said fulcrum to said bobbin and comprising:

a frame inclined at an angle relative to a plane perpendicular to the main moving direction of said yarn;

first traverse means for traversing said yarn from ends of said traverse stroke toward a center of said traverse stroke, which means is rotatably supported on said frame and spaced downstream of said fulcrum for traverse motion by a predetermined distance, and which means comprises at least a pair of rotary blades;

axes of rotation of said rotary blades of said first traverse means being located proximate said ends of said traverse stroke; and second traverse means for traversing said yarn, having been transferred from said first traverse means, from said center of said traverse stroke toward said ends of said traverse stroke, which means is rotatably supported on said frame and spaced apart from said first traverse means by a predetermined distance along said main moving direction of said yarn, and which means comprises at least a pair of rotary blades;

axes of rotation of said rotary blades of said second traverse means being located proximate said ends of said traverse stroke and laterally offset from said axes of rotation of said rotary blades of said first traverse means in a direction perpendicular to said traverse stroke.

7. A yarn traversing apparatus according to claim 6, which is so arranged that said yarn is released from one of said rotary blades of said second traversing means after it is moved by one of said rotary blades of said second traversing means to a position where said fulcrum for traverse motion, said first traversing means and a contact point where said yarn moved by said first traversing means is in contact with said contact roller are slightly deviated opposite to said center of said traverse stroke from a straight line connecting said fulcrum for traverse motion and said contact point.

* * * * *

UNITED STATES PATENT AND TRADEMARK OFFICE

CERTIFICATE OF CORRECTION

PATENT NO. : 5,149,002

DATED : September 22, 1992

INVENTOR(S) : Takami Sugioka

It is certified that error appears in the above-identified patent and that said Letters Patent is hereby corrected as shown below:

Col. 3, line 58, "fro" should be --from--.

Signed and Sealed this

Ninth Day of November, 1993

*Attest:*

*Attesting Officer*

BRUCE LEHMAN

*Commissioner of Patents and Trademarks*